United States Patent [19]

Scholander

[11] 4,345,964

[45] Aug. 24, 1982

[54] APPARATUS FOR THE APPLICATION OF A PLIABLE WEB OF MATERIAL ONTO CORRUGATED SHEET

[76] Inventor: Stig S. W. Scholander, Karlbergsvägen 68 B, S-113 35 Stockholm, Sweden

[21] Appl. No.: 200,540

[22] Filed: Oct. 24, 1980

[30] Foreign Application Priority Data

Oct. 29, 1979 [SE] Sweden ..... 7908943

[51] Int. Cl.[3] ..... E04C 2/26

[52] U.S. Cl. ..... 156/468; 156/470; 156/475

[58] Field of Search ..... 156/96, 210, 212, 293, 156/468, 470, 475

[56] References Cited

U.S. PATENT DOCUMENTS 3,682,747 8/1972 Munters ..... 156/470

FOREIGN PATENT DOCUMENTS 2433136 1/1976 Fed. Rep. of Germany .

*Primary Examiner*—Marion McCamish

*Attorney, Agent, or Firm*—Burton, Parker & Schramm

[57] ABSTRACT

Described is an apparatus for the application of a thin non-woven web of glass or mineral fibers onto corrugated sheet perpendicularly to the corrugation which comprises a rectangular frame open at the top and bottom and having parallel vertical walls, wherein the frame is provided with wheels and supported on rails above the sheet material which is supported by a matrix on working-level above the floor and coated with a layer of a solidifying glue. An applicator plate is mounted vertically movable in guideways at two opposite walls of the frame and adapted with its bottom edge to follow the corrugations of the sheet to bring the fibrous web into close contact with the glue-coated sheet. Because of the delicacy of the fibrous web of material, the lower end of the applicator plate which is adapted to press the web of material against the sheet, must be rounded. However, with the forward and backward flutes in the valleys of the corrugations, having a radius of about 3 mm, the lower end of the applicator plate presents two rounded edges each having a radius of curvature of at the most about 3 mm. In order to provide for a close contact between the rounded edges of the applicator plate and the respective forward and backward flutes in the valleys of the corrugations, the applicator plate is adapted by means of a sensor-controlled driving device to be swung periodically to and fro with a deflection of about 3°-5° from the vertical line in either direction according as the frame is being moved by means of a driving device at a constant velocity over the sheet perpendicularly to the corrugations with the applicator plate following the corrugations of the sheet.

6 Claims, 4 Drawing Figures

APPARATUS FOR THE APPLICATION OF A PLIABLE WEB OF MATERIAL ONTO CORRUGATED SHEET

BACKGROUND OF THE INVENTION

The present invention relates to an apparatus for the application of a pliable web of material onto corrugated sheet.

Through U.S. Pat. No. 3,773,603 a building element for uninsulated roofing and walls is known, which comprises an even or corrugated sheet element which for the purpose of preventing the dripping of condensation water is coated with a glass fiber layer about 0,5 to 1 mm thick.

The patented corrugated roof element is marketed since several years under the trademark NOCONDROP.

Initially, a rational production of the roofing elements coated with a thin web of non-woven glass fibers on an industrial basis turned out to be difficult. Originally, they were produced on a purely handicraft basis starting from finished trapezoidally corrugated sheet elements which were placed on a table and sprayed with a glue. The problem was the application of the thin fiber web, having a thickness of only about 0,5 to 1 mm, in a pleated condition perpendicularly to the corrugations of the sheet element. By means of a wooden board about 15 mm thick the fiber web was pressed down into the corrugations and glued to the sheet. Obviously, this was a very trying work resulting in a small output.

Accordingly, with the increasing demand for the NOCONDROP roofing the provision of a more rational production technique came to the fore. One solution resulted in in that, currently, the sheet metal is manufactured into its finished condition except the corrugation. The flat sheet metal is finished in the conventional manner, lacquered on one side in the desired color and the mineral fiber layer glued on the other side. Only thereafter the sheet material is passed through a stripforming machine including a plurality pairs of profile rollers the profile depth of which increases successively from the center towards the edges. It should be appreciated that the manufacturing procedure described presupposes access to the strip-forming machine of a large steel- or aluminum-works, and because the production of NOCONDROP elements at least for the time being comprises only a relatively small part of the total production of corrugated sheet of the steel- or aluminumworks, this implies that change-over of the strip-forming machine from the normal production to the production of the present elements and return to normal production is accompanied by high costs which, in turn, results in that the profitability for the production of the fiber-coated sheet elements presupposes that the rearrangements of the strip-forming machine are not made too frequently and that a great number of orders must be piled before a rearrangement may be made.

Obviously, the described large-scale production of fiber-coated corrugated sheet elements has also its limitations as long as a large-scale strip-forming machine is fully occupied with the normal production. Moreover, most countries have no steelworks with strip-forming machines.

SUMMARY OF THE INVENTION

The problem behind the invention is to provide an apparatus for the application of a fiber web onto precorrugated sheet elements. I have discovered that an extremely satisfactory deposition of a thin web of material such as a glass or mineral fiber web onto corrugated sheet sprayed with a glue may be attained by the provision of an apparatus by means of which the web of material is applied to the corrugated sheet perpendicularly to its corrugations, with the web of material adhering to the corrugations in complete contact.

DESCRIPTION OF THE DRAWINGS

The invention will be described hereinafter in more detail with reference to the accompanying drawings, in which.

BRIEF DESCRIPTION OF PREFERRED EMBODIMENTS

Figure 1:
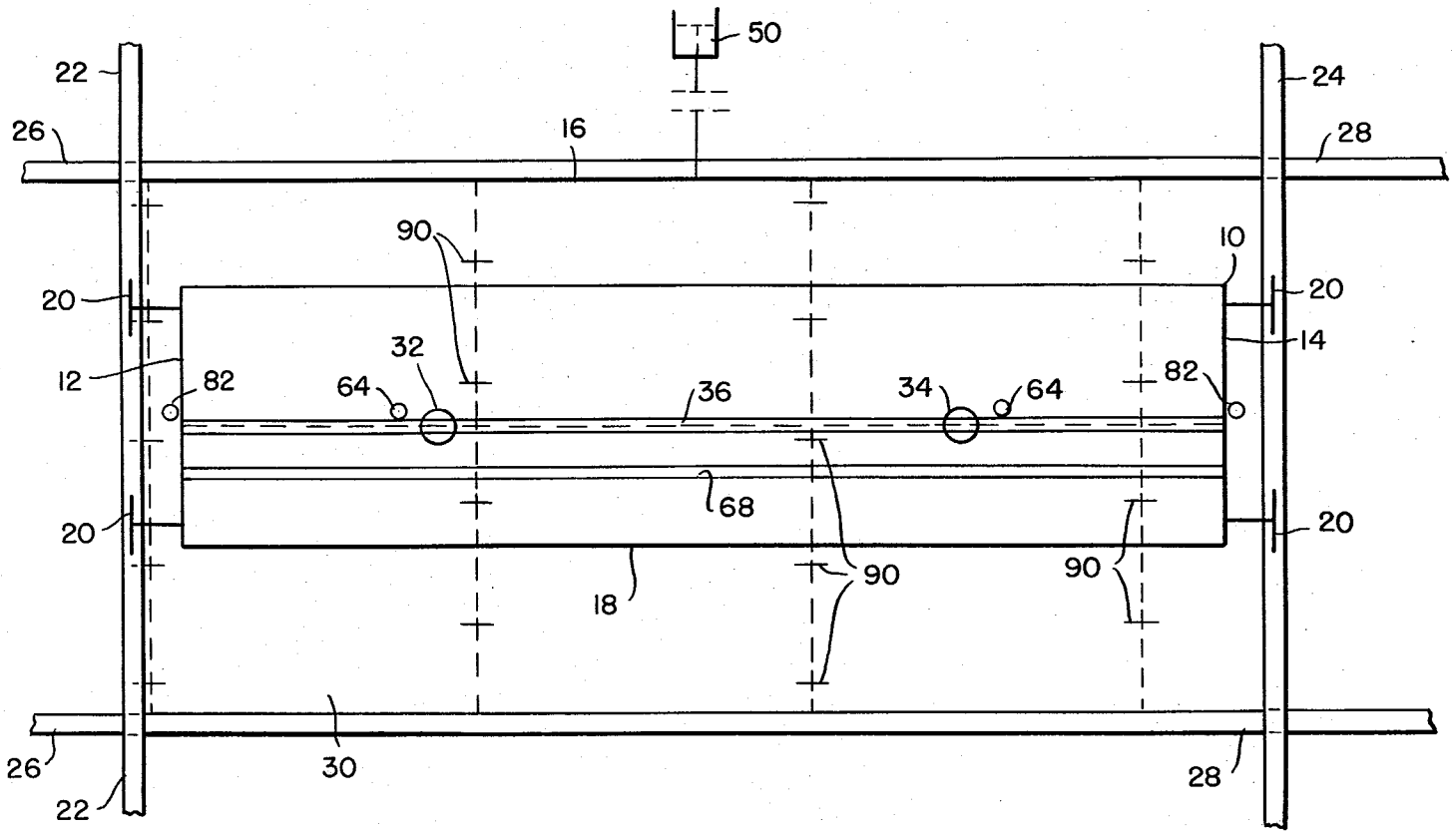
FIGS. 1–3 show top plan, side elevation and front elevation views, respectively, of a coating apparatus embodying the invention.
Figure 2:
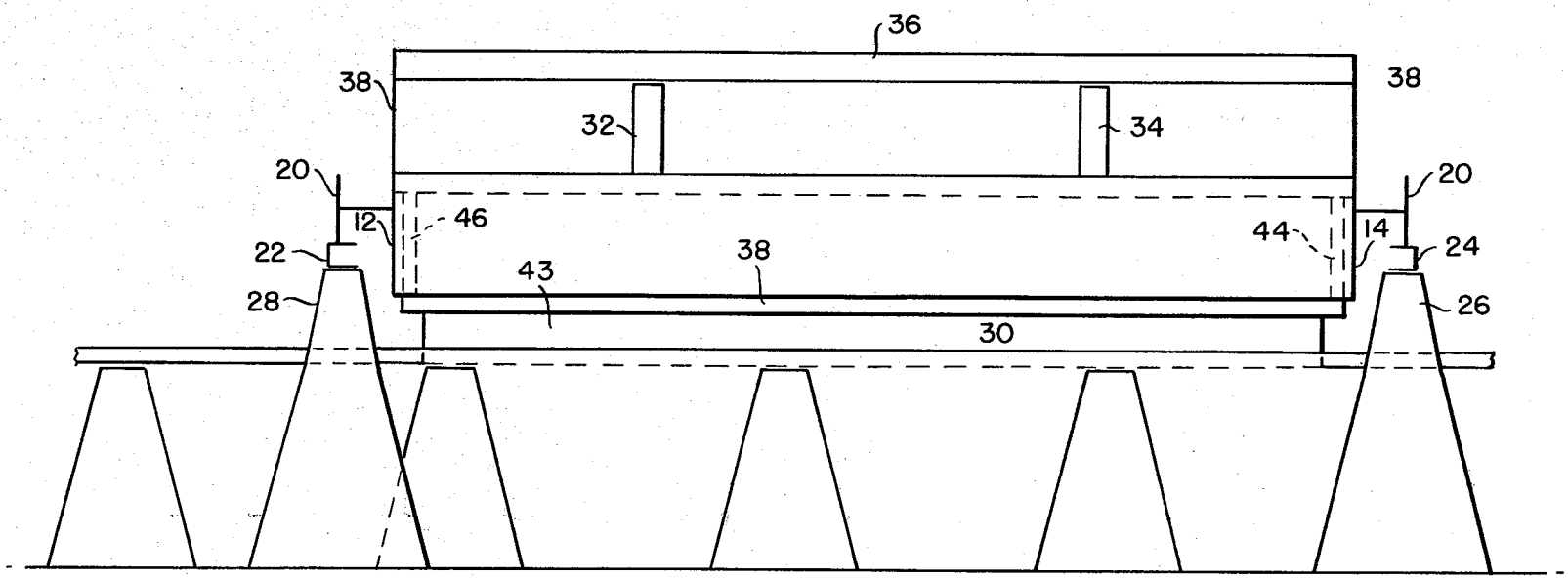
Figure 3:
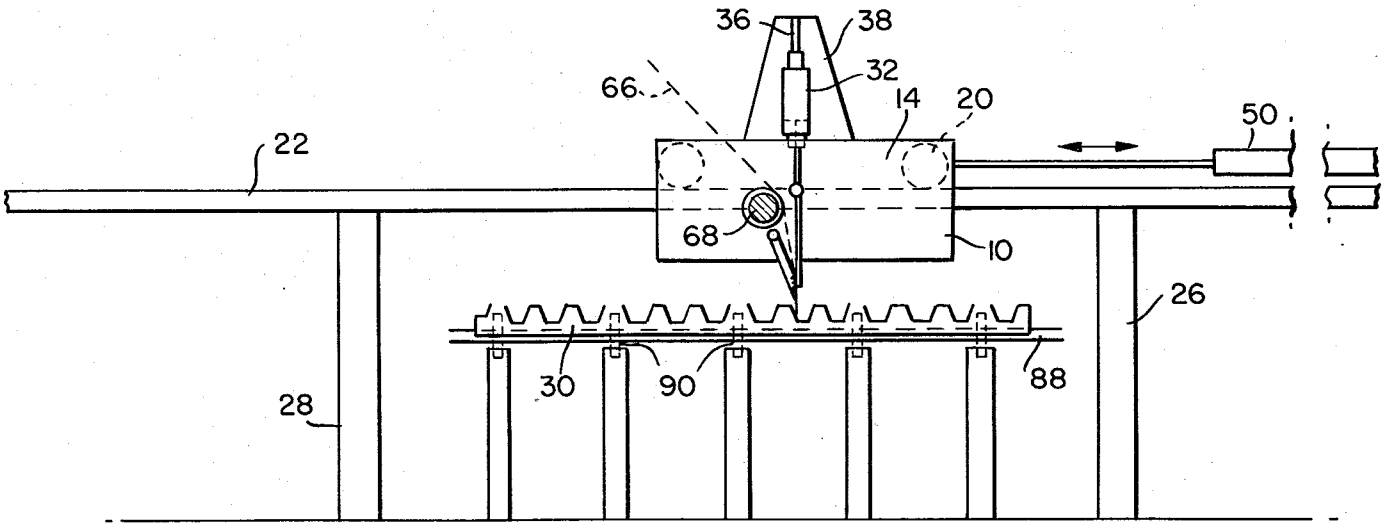

The coating apparatus shown diagrammatically in FIGS. 1 to 4 comprises a rectangular frame 10 with parallel short sides 12,14 and long sides 16,18 made from sheet steel, by way of example. The frame 10 is carried by four wheels 20 mounted at the short sides 12,14 and supported by two parallel rails or beams 22,24 resting on supports 26,28 approximately on working level, i.e. about 80–100 cm above the floor. On a level above the floor but some decimeters below the frame a matrix 30 with trapezoidal corrugation is provided for the trapezoidally corrugated sheet elements to be coated. Instead of the wheels 20, the frame 10 could be provided with guide rails slidably mounted in guidways which are secured to the beams 22,24 (not shown).

Two pressurized fluidum-operated cylinder-piston assemblies 32,34 are secured with one of their respective ends to the web edge of a T-beam 36 which, with its web facing downwards, is welded to brackets 38 which in turn are welded on the short sides 12,14 of the frame 10 and extend vertically upwards in the same plane as these. The piston rods, 40,42 of the cylinder-piston assemblies 32,34 are attached to a supporting bar 43 extending across the frame 10 and slidably mounted in guideways 44,46 at the opposite walls 12,14.

In the following description of the function of the machine the assembly of the frame 10 and a coating mechanism housed therein carried by the wheels 20 on the rails 22,24 is called the "carriage". The carriage is adapted by means of a pneumatic plunger 50 or other suitable driving means to be reciprocated along the track in the course of applying a fiber web on to the sheet material 49 perpendicularly to the extension of the corrugations.

The coating mechanism 48 is suspended from the supporting bar 43 by means of hinges 51 so that it may be raised and lowered in the frame 10. The coating mechanism comprises a rectangular applicator plate 52 suspended from the hinges 51, said applicator plate being swingable to and fro by a small angle (about 3°–5°) on both sides of the vertical line. The lowermost edge portion of the applicator plate 52 comprises a detachable doctor 53 of hard metal in order to resist hard wear when trailing over the mineral fiber web. It is obvious that with the coating mechanism in its uppermost working position, the doctor 53 should reach below the bottom edge of the frame 10. By way of example, the hard metal doctor 53 is fastened to the bottom edge of the applicator plate 52 by means of stud bolts 54 secured in the doctor 53 and slipped through vertical bores with their ends terminating in a through hole 56 in the plate 52 and tightened with nuts 58.

For the purpose of controlling the pivotal motion of the applicator plate 52, pivotally mounted between a bracket 60 protruding perpendicularly to the applicator plate 52 and a bracket 62 protruding perpendicularly to the supporting bar 43, is a fluidum-operated cylinder-piston assembly 64 through the actuation of which the applicator plate 52 may be set into a desired angular position in relation to the vertical plane.

In order to guide a fiber web 66 into the working area of the applicator plate 52 from a stock reel (not shown), use is made of a guide roller 68 which has to follow the applicator plate in its movements upwards and downwards. For this purpose, at the ends of the applicator plate 52, brackets 70 protruding perpendicularly to the plate are mounted (on the side opposite to the bracket 69), between which the guide roller 68 is rotatably mounted.

Further, a material holder 74 in the shape of an oblong plate extending over the entire width of the web of material is pivotally mounted on pivots 72 between the applicator plate 52 and the guide roller 68 and obliquely below the latter, the lower edge of said material holder presenting a bevelled knurled surface 76 adapted upon turning the material holder 74 to the right according to the figure, to be brought into contact with the side wall of the applicator, plate 52 which side wall may also if desired be knurled in the contact area of the material holder 74.

For the operation of the material holder 74 a pair of levers 78 are rigidly connected to its pivots 72, said levers extending obliquely downwards outside the ends of the material holder in the space between said ends and the inner walls of the frame 10. On the opposite side of the applicator plate 52 below its hinges 51 protruding brackets 80 are welded above and in the same vertical plane as the levers 78. Mounted between the respective ends of the levers 78 and the brackets 80 is a pair of fluidum-operated cylinder-piston assemblies 82 adapted to actuate the material holder 74. In the course of a coating operation the material holder is kept removed from the fiber web 66 to provide a gap of about 3–5 mm for passage of the fiber web 66. However, before subsequently to a terminated coating operation the fiber web is cut off, it is necessary by actuation of the cylinder-piston assemblies 82 to swing the material holder 74 towards the applicator plate 52 with the bevelled surface pressing against the fiber web so that its end edge is retained in the initial position required for next coating step.

Figure 4:
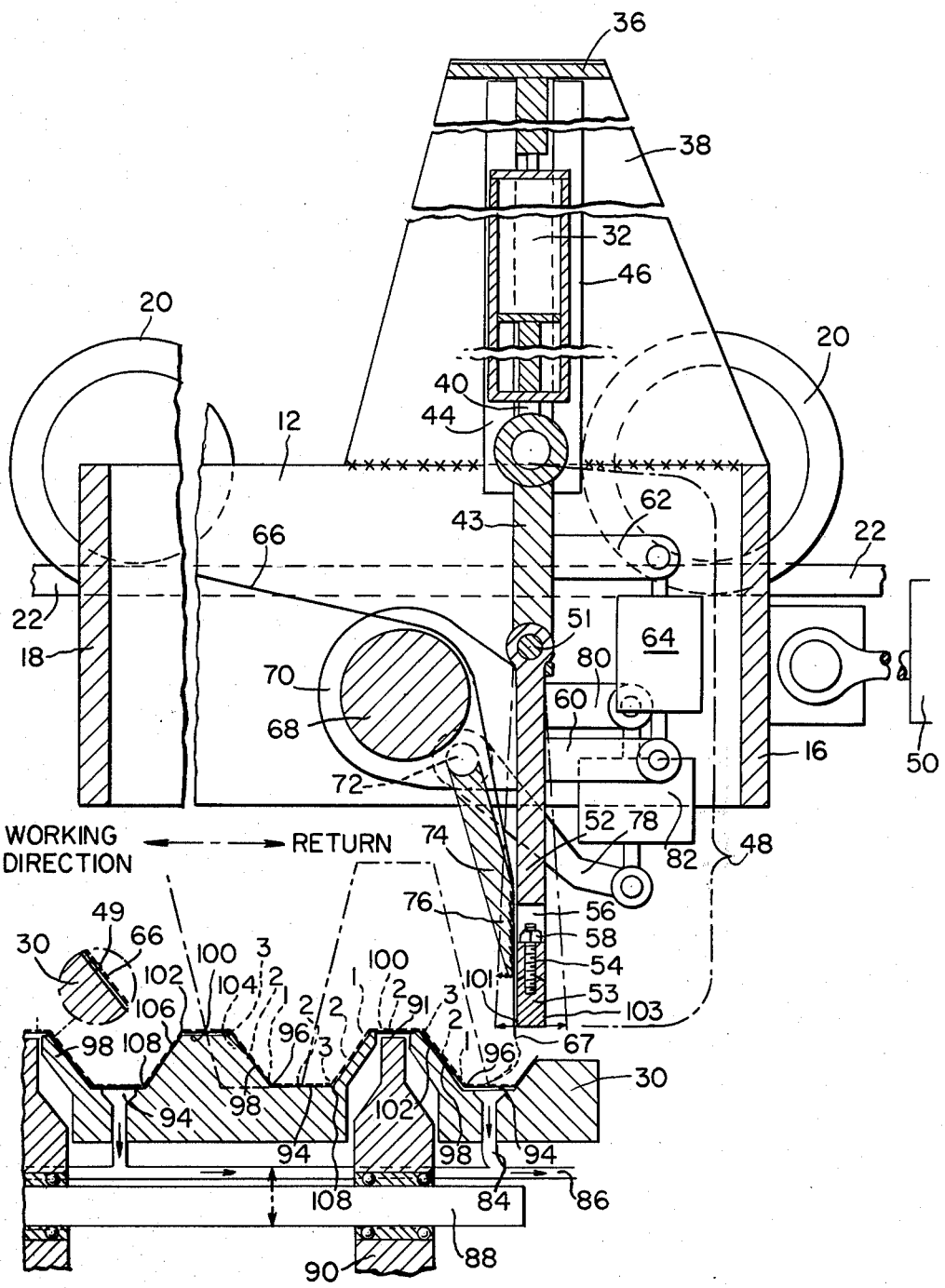
FIG. 4 shows an enlarged vertical sectional view taken along the travelling direction of the apparatus.

In FIG. 4, a matrix 30 for supporting and keeping corrugated sheet elements in place is also shown. Since trapezium-corrugated sheet is manufactured with different dimensions of the height, width and spacing etc. of the corrugations, one matrix is required for each type of sheet. Since it is essential that the sheet element is kept in place in the course of the coating operation, the matrix shown in the figure is provided in its valleys with through holes 84 communicating with a manifold 86 which in turn is connected to a vacuum source (not shown). The matrix 30 should have a width at least equal to the width of the corrugated sheet material to be coated, i.e. at least about 1.2 m and in general not larger than 1.4 m. Similarly, the length of the matrix is governed by the maximum width of the fiber web which, in general, is not larger than 1.4 m.

Moreover, the matrix 39 is provided with rubber-faced supporting wheels 90 distributed in spaced relationship in the longitudinal and latitudinal directions and rotatably mounted on shafts 88 which may be raised and lowered so that, in the course of the coating operation, the wheels 90 are lowered below the corrugated surface of the matrix but in the course of loading and unloading of sheet elements are raised through openings 91 in the matrix so that the sheet element may be moved along the matrix without its lacquered surface trailing on the matrix and getting scratched.

At the end of the matrix 30 remote from the applicator plate 52 a cutting device such as, by way of example, a rotary knife (not shown) is provided for cutting off the fiber web subsequent to the application of a fiber layer onto the corrugated sheet element.

The operation of the coating machine described above presupposes an exactly calculated interaction of four driving systems: the cylinder-piston assembly 50 (hereinafter referred to as "traction motor"), for moving the machine over the corrugations at an adequate speed during the application and back to the initial position at a high speed after the application; the cylinder-piston assemblies 32, 34 ("lifting motor"), for raising and lowering the coating mechanism 48; the cylinder-piston assembly 64 ("inclination motor"), for adjusting the angle of inclination of the applicator plate 52; and the cylinder-piston assemblies 82 ("keeper motor"), for operation of the material holder 74.

The operation of said four driving systems in coordinated interaction may be effected by means of various automatic control systems known to a person skilled in the art. A fully-mechanic motion transmission mechanism is less suitable since the machine should be amenable to easy change-over to different trapezium profiles. However, with the hydraulics described, or by means of separate electric motors for each type of motion, it is a relatively simple matter for a person skilled in the art to develop a program which may be controlled by a punch tape or magnetic tape, it being then a matter of course that also other operations involved in the application process may be combined in a fully-automatic control program, i.e. operation of the cutting device, the glue spraying system, raising and lowering of the wheel shafts 88, evacuation of the matrix 30, and conveyance of the sheet elements.

Glueing of a web of glass or mineral fibers to corrugated roofing sheet is a delicate procedure posing great claims on the mechanical performance. The starting material is already corrugated and frequently also lacquered on the upper side. The sheet is laid on a table, with the lacquered side facing downwards, and sprayed with a thermosetting glue with restricted curing time. A drizzling rain of the glue strikes the sheet as an infinite number of minute droplets, the slightest touch with the fiber layer causing it to stick firmly to the glue without capability of being dislodged. Therefore, prior to deposition on the sheet sprayed with glue, the fiber web must be kept well stretched and leveled throughout its width and under careful straightening by means of the doctor 53 be strapped firmly to the glue layer along all lower and upper flat surfaces 94,100 and upwards and downwards sloping surfaces 98,106 of the corrugations. The transitions between the valleys 94 and sloping surfaces 98,106 of the corrugations have the shape of flutes 96,108 with a radius of, say, about 3 mm, which must be coated with the fiber layer in complete contact. On account of the flutes 96,108 of the corrugations, the underside of the doctor 53 must present rounded edges scarcely 3 mm in radius, for which reason the doctor should be capable of being tilted both forwards and backwards in various stages of the coating operation.

The mode of operation of the apparatus according to the invention will now be described briefly. Supposing that subsequently to deposition of a fiber layer, the frame 10 has been returned to the initial position shown in FIG. 4 and that by actuation of the keeper motor 82 the fiber web is clamped against the applicator plate 52 by the aid of the knurled surface 76 of the material holder 74, with an edge strip 67 of some centimeter in width suspended from the edge of the doctor 53. At the outset of the deposition procedure, the doctor is moved by the traction motor 50 and lifting motor 32 in cooperation forwards (to the left according to the figure) and downwards until the free end 67 of the fiber web 66 is passed in below the rounded leading edge 101 of the doctor 53 and pressed firmly against the first valley 94 slightly short of the forward flute 96 where the first uphill 98 begins. At that moment, the material holder 74 is swung forward by the keeper motor 82 until a gap of about 3 mm is created between the applicator plate 52 and the material holder 74 to allow free passage of the fiber web therethrough. At this stage, the applicator plate with the doctor 53 should slope slightly backward as seen in the direction of the working stroke of the carriage, as indicated with a dashed line 1 drawn to the flute 96, thereby causing the rounded leading edge 101 of the doctor to coincide completely with the curvature of the flute 96 in the valley 94 of the corrugation, and the fiber layer to cover the flute without leaving any void space therebetween.

In the path along the uphill 98 subsequently to be followed by the doctor 53, the applicator plate 52 is raised by action of the lifting motor 32, and in a coordinated movement through continued propulsion by the traction motor 50, the doctor 53 is steered along the upwards sloping surface 98. Simultaneously, by actuation of the inclination motor 64, the doctor 53 is moved into vertical position (line 2) and maintained in that position until, after passage of the uphill 98, the doctor reaches the back edge 102 of the top surface 100. Subsequently, the lifting motor 32 is stopped and, with continued propulsion of the carriage by the traction motor 50, the inclination motor 32 is actuated to move the applicator plate 52 into a slight forward slope (line 3). With stopped lifting motor 32 the propulsion of the carriage by means of the traction motor 50 is continued and the driving direction of the inclination motor 64 reversed so that during the time required for passing the flat top surface 100 of the corrugation, the applicator plate 52 will have been returned to its initial backward slope (line 1) at the moment the doctor reaches the front edge 104 of the flat top surface 100 of the corrugation.

Subsequently, in the path along the downhill 106 to be followed by the doctor 53, the applicator plate 52 is lowered by actuation of the lifting motor 32, and in a coordinated movement with the continuous propulsion with the traction motor 50, the doctor 53 is moved along the sloping surface of the downhill 106 simultaneously as the inclination motor 64 is turning the applicator plate 52 into a slight forward slope (line 3) thus rendering it possible for the doctor 53 upon arrival to the flute 108 to fit with its rounded trailing edge 103 into the flute so that the fibrous material will be glued therein without voids.

During continued propulsion of the traction motor 50 the described steps are repeated according to the control pattern described, until the entire sheet has been coated and the carriage has reached the end position of the propulsion of the traction motor 50. After pulling out a further strip 67 of the fibrous web about 1 cm in width below the bottom edge of the doctor 53 (see the initial position in FIG. 4), the traction motor 50 is stopped and its driving direction reversed for starting of a rapid return to the initial position. At the same time, the lifting motor 32 is stopped with the applicator plate 52 in raised position and the keeper motor 82 actuated causing the levers 78 to turn the material 74 counterclockwise according to the figure, pressing and retaining with its beveled surface 76 the fibrous web against the applicator plate 52. At that moment, a rotary knife (not shown) is actuated by the aid of means not shown, cutting the web along the edge of the sheet in a forward movement and then returned to the initial position. Subsequently, the suction in the passages of the matrix 30 is released and the wheel shafts 88 raised so that, by engagement with the rubber-faced wheels 90, the finally coated sheet is lifted a few millimeters from the matrix so that it may be rolled away without scratching and another sheet rolled in to be sucked caught and coated. In the course of these moments being effectuated, the traction motor 50 for rapid return of the carriage to its initial position is started, where the traction motor is stopped and changed over for starting of the forward motion. With that the machine has completed an operation cycle.

Although the invention has been described in particular embodiments and examples, it will be clear that modifications and changes in materials and structure can be made by those skilled in the art within the scope of the invention as defined in the appended claims.

What is claimed is:

1. Apparatus for the application of a pliable web of material onto corrugated sheet, including a rectangular frame open at the top and bottom and having parallel vertical walls, means for supporting the frame above the sheet material to be coated, and means for moving the frame perpendicularly to the extension of the corrugations of the sheet, comprising:

(a) a supporting bar slidably mounted with its ends in vertical guideways between two opposite walls of the frame, lifting means carrying said supporting bar vertically displaceable from a beam extending across said frame and rigidly connected to said opposite frame walls; an applicator plate pivotally connected to said supporting bar and suspended therefrom, the bottom edge of said applicator plate being adapted in the course of depositing the web of material, to press a free end portion of the web of material firmly to a sheet sprayed with glue and by coordinated propulsion of the frame by said driving means and lifting and lowering of said supporting bar through the action of said lifting means, to follow the corrugations of the sheet for pressing the web of material firmly thereto; and (b) tilting means for adjusting the angle of inclination of the applicator plate in swinging movements coordinated with the forward movement of the frame through the action of said driving means and the lifting and lowering movements of the applicator plate through the action of said lifting means.

2. The apparatus of claim 1 wherein said driving means comprises a fluidum-operated cylinder-piston assembly for moving the applicator plate over the corrugations at an adequate speed in the course of an application operation and, subsequently to the application operation, back to the initial position at a high speed.

3. The apparatus of claim 1 wherein said lifting means comprises a pair of fluidum-operated cylinder-piston assemblies carried by said supporting bar and displaceable in vertical guideways between two opposite walls of the frame.

4. The apparatus of claim 1 wherein said tilting means comprises a fluidum-operated cylinder-piston assembly mounted to said supporting bar and applicator plate between brackets secured one to the supporting bar and the other to the applicator plate, for adjusting the angle of inclination of the applicator plate in swinging movements coordinated with the forward propulsion of the frame and the lifting and lowering movements of the applicator plate.

5. Apparatus for the application of a pliable web of material such as a thin non-woven web of glass or mineral fibers bonded together at the points of crossing by a glue, on to corrugated sheet, including a rectangular frame open at the top and bottom and having parallel vertical walls, means for supporting the frame above the sheet material to be coated, and means for moving the frame perpendicularly to the extension of the corrugations of the sheet, comprising:

(a) a supporting bar slidably mounted in vertical guidways between two opposite walls of the frame, said supporting bar being carried vertically displaceable via fluidum-operated cylinder-piston assemblies from a beam extending across said frame and rigidly connected to said opposite frame walls; an applicator plate pivotally connected by means of hinges to said supporting bar and suspended therefrom, the bottom edge of said applicator plate being adapted in the course of depositing the web of material to press the free end portion of the web of material firmly to a sheet sprayed with glue, and by coordinated propulsion of the frame by means of said driving means and lifting and lowering of said supporting bar by means of said cylinder-piston assemblies, to follow the corrugations of the sheet for pressing the web of material firmly thereto;

(b) a fluidum-operated cylinder-piston assembly mounted to the supporting bar and applicator plate between brackets for adjusting the angle of inclination of the applicator plate in swinging movements coordinated with the forward movement of the frame and the lifting and lowering movements of the applicator plate;

(c) a guide roller for guiding the web of material into the working area of the applicator plate, said guide roller being rotatably mounted between brackets mounted at the extreme ends of the applicator plate perpendicularly to the surface of said plate on the opposite side of said brackets; and (d) a material holder pivotally mounted on pivots between the applicator plate and guide roller and obliquely below the latter, said material holder having the shape of an oblong plate extending across the entire width of the web of material, the lower edge of said material holder presenting a beveled knurled surface; a pair of levers rigidly connected to the pivots of the material holder and extending outside the ends of the material holder through the space between said ends and said opposite walls of the frame, a pair of brackets mounted on the opposite flat side of the applicator plate perpendicularly thereto above and in the same plane as said levers, and a pair of fluidum-operated cylinder-piston assemblies pivotally mounted between respective ends of the levers and brackets for swinging the material holder in relation to the applicator plate.

6. The apparatus of claim 5 wherein said frame is movably carried by wheels on two rails resting on supports on a level above the floor.

* * * * *